US009231384B2

(12) United States Patent
Stewart

(10) Patent No.: US 9,231,384 B2
(45) Date of Patent: Jan. 5, 2016

(54) METHOD FOR COATING SPARK PLUG THREADS WITH A POLYTETRAFLUOROETHYLENE MIXUTRE

(71) Applicant: Kevin Stewart, Ottawa (CA)

(72) Inventor: Kevin Stewart, Ottawa (CA)

(73) Assignee: Kevin Stewart, Ottawa, Ontario (CA)

( * ) Notice: Subject to any disclaimer, the term of this patent is extended or adjusted under 35 U.S.C. 154(b) by 41 days.

(21) Appl. No.: 13/946,297

(22) Filed: Jul. 19, 2013

(65) Prior Publication Data

US 2014/0220234 A1 Aug. 7, 2014

(30) Foreign Application Priority Data

Feb. 4, 2013 (CA) ..... 2805496

(51) Int. Cl.

| | |
|---|---|
| ***B05D 3/02*** | (2006.01) |
| ***H01T 21/02*** | (2006.01) |
| ***H01T 21/04*** | (2006.01) |
| *H01T 13/06* | (2006.01) |
| *H01T 13/08* | (2006.01) |
| *B05D 1/02* | (2006.01) |

(52) U.S. Cl.

CPC ..... *H01T 21/02* (2013.01); *H01T 21/04* (2013.01); *B05D 1/02* (2013.01); *B05D 3/02* (2013.01); *H01T 13/06* (2013.01); *H01T 13/08* (2013.01)

(58) Field of Classification Search

USPC ..... 427/58, 242, 388.1

See application file for complete search history.

(56) References Cited

U.S. PATENT DOCUMENTS

| | | | | |
|---|---|---|---|---|
| 2,728,929 | A * | 1/1956 | Bell | 15/104.011 |
| 2,753,839 | A * | 7/1956 | Clark | 118/410 |
| 4,028,851 | A * | 6/1977 | Fricke | 451/77 |
| 4,165,586 | A * | 8/1979 | Fricke | 451/38 |
| 6,452,314 | B1 * | 9/2002 | Boehler | 313/141 |
| 2003/0151342 | A1 * | 8/2003 | Venn et al. | 313/143 |

* cited by examiner

*Primary Examiner* — Brian K Talbot

(74) *Attorney, Agent, or Firm* — Pergament Gilman & Cepeda LLP

(57) ABSTRACT

The invention relates to a method for coating spark plug threads with a polytetrafluoroethylene mixture comprising the steps of (a) bringing the spark plug to room temperature of 21° C. to 26° C. (70° F. to 79° F.); (b) mixing the polytetrafluoroethylene mixture thoroughly and filtering the material through a 100-mesh stainless steel screen (0.146 mm openings); (c) applying a minimum dry film thickness of 20 microns to 30 microns (0.8 mil to 1.2 mil) to the spark plug thread; and (d) baking the spark plug for 15 minutes at a metal temperature of 232° C. to 260° C. (450° F. to 500° F.).

6 Claims, No Drawings

METHOD FOR COATING SPARK PLUG THREADS WITH A POLYTETRAFLUOROETHYLENE MIXUTRE

FIELD OF THE INVENTION

This invention relates to spark plug devices and, more particularly, to a method of coating spark plug threads with a polytetrafluoroethylene mixture.

BACKGROUND OF THE INVENTION

Spark plugs operate at high temperatures and are prone to "seizing" in an engine and becoming adhered to the surrounding aluminum or stripping.

Polytetrafluoroethylene (PTFE) is a synthetic fluoropolymer of tetrafluoroethylene that finds numerous applications. The best known brand name of PTFE is Teflon™ by DuPont Co.

PTFE is used as a non-stick coating for pans and other cookware.

PTFE has been used as a thread seal tape in plumbing applications, as well as for coating armor-piercing bullets to prevent the increased wear on the firearms' rifling. Some car owners have used PTFE tape to wrap around spark plugs with limited success. PTFE, like all polymeric materials, deteriorates over time when exposed to certain temperature levels. In this application, where the PTFE is attached to an operating spark plug in a stationary engine application, the continuous exposure to elevated operating temperatures will accelerate PTFE's loss of electrical insulation capabilities.

Using PTFE tape also has the disadvantage that the PTFE tape will burn off and turn to dust and foul the threads.

It would be advantageous to have a method of coating spark plug threads with a PTFE mixture to avoid the disadvantages of using a PTFE tape.

SUMMARY OF THE INVENTION

The object of the invention is to increase the working life and the operating reliability of a spark plug.

The invention relates to a method for coating spark plug threads with a polytetrafluoroethylene mixture comprising the steps of (a) bringing the spark plug to room temperature of 21° C. to 26° C. (70° F. to 79° F.); (b) mixing the polytetrafluoroethylene mixture thoroughly and filtering the material through a 100-mesh stainless steel screen (0.146 mm openings); (c) applying a minimum dry film thickness of 20 microns to 30 microns (0.8 to 1.2 mil) to the spark plug thread; (d) baking the spark plug for 15 minutes at a metal temperature of 232° C. to 260° C. (450° F. to 500° F.).

DETAILED DESCRIPTION

Prior to applying a polytetrafluoroethylene mixture to a spark plug thread, the surface is cleaned by using a vapour degrease or by prebaking.

The surface is then lightly grit-blast with aluminum oxide (e.g. 120-180 microinches). Other pretreatments for corrosion resistance can be carried out as well prior to application of the coating to the part. Application of conversion coatings is suggested where grit blasting is not practical and/or where additional corrosion protection is specified.

The coating should be applied immediately after blasting on carbon steel to avoid flash rusting.

The spark plug thread is then coated with a polytetrafluoroethylene mixture comprising the steps of: (a) bringing the spark plug to room temperature of 21° C. to 26° C. (70° F. to 79° F.); (b) mixing polytetrafluoroethylene mixture thoroughly and filtering the material through a 100-mesh stainless steel screen (0.146 mm openings); (c) applying a minimum dry film thickness of 20 microns to 30 microns (0.8 mil to 1.2 mil) to the spark plug thread; (d) baking the spark plug for 15 minutes at a metal temperature of 232° C. to 260° C. (450° F. to 500° F.). In this embodiment, a PTFE mixture similar to DuPont 857G-508 having weight solids % of 37-41, volume solids % 26-30, density, kg/L 1.17 (9.22 lb/gal), viscosity 450-750, with a maximum in-use temperature of 204° C. (400° F.) has been found to be effective.

In a second embodiment the spark plug threads is coated with a polytetrafluoroethylene mixture comprising the steps of: (a) bringing the spark plug to room temperature of 21° C. to 26° C. (70° F. to 79° F.) and mixing or rolling thoroughly at 30 rpm for 30 minutes to 60 minutes; (b) stringing the polytetrafluoroethylene mixture thorough a 100-mesh stainless steel screen (0.146 mm openings); (c) using conventional industrial air-assisted spray equipment to apply a minimum dry film thickness of 20 microns (0.8 mil) to the spark plug thread; (d) baking the spark plug for 15 minutes at a metal temperature of 370° C. for 10 minutes or 400° C. for 5 minutes. In this embodiment, a PTFE mixture similar to DuPont 420G-104 having weight solids % of 24.0-27.5, volume solids % 0 12.9-14.9, density, kg/L 1.10 (9.22 lb/gal), viscosity 900-1400, with a maximum in-use temperature of 260° C. (500° F.) has been found to be effective. Similarly effective has a PTFE mixture similar to DuPont 420G-109 having weight solids % of 20.3-23.3, volume solids % 11.8-13.8, density, kg/L 1.05 (8.78 lb/gal), viscosity 900-1400, with a maximum in-use temperature of 260° C. (500° F.).

In a third embodiment, the spark plug threads are coated with a polytetrafluoroethylene mixture comprising the steps of: (a) bringing the spark plug to room temperature 21° C. to 26° C. (70° F. to 79° F.); (b) cleaning and degreasing the surface of the spark plug by gritblasting to achieve a Ra of 2.5-3 microns (110-125 M in) maximum; (c) mixing the polytetrafluoroethylene mixture thoroughly and filtering the material through a 60-mesh stainless steel screen (250 mm openings); (e) applying a minimum dry film thickness of 25 to 100 microns (1.0 to 4.0 mil) to the spark plug thread; (f) baking the spark plug for 20-30 minutes at a metal temperature of 370° F. to 370° F.). In this embodiment, a PTFE mixture similar to DuPont 532G-5010 having average particle size, μm of 34.5-46.9, bulk density g/100 cc 64-86 with a maximum in-use temperature of 260° C. (500° F.) has been found to be effective. Similarly effective has been a PTFE mixture similar to DuPont 532G-5011 having average particle size, μm of 21.2-31.6, bulk density g/100 cc 62-83 with a maximum in-use temperature of 260° C. (500° F.) has been found to be effective. Similarly effective has been a PTFE mixture similar to DuPont 532G-5310 having average particle size, μm of 34.5-46.9, bulk density g/100 cc 64-93 with a maximum in-use temperature of 260° C. (500° F.) has been found to be effective. Similarly effective has been a PTFE mixture similar to DuPont 532G-7000 having average particle size, μm of 34.5-46.9, bulk density g/100 cc 56-86 with a maximum in-use temperature of 260° C. (500° F.) has been found to be effective.

In a fourth embodiment, the spark plug threads are coated with a polytetrafluoroethylene mixture comprising the steps of: (a) bringing the spark plug to room temperature of 21 to 26° C. (70° F. to 79° F.); (b) mixing the polytetrafluoroethylene mixture thoroughly and filtering the material through a 100-mesh stainless steel screen (250 mm openings); (e) using conventional industrial spray equipment applying a minimum dry film thickness of 25 microns to 100 microns (1.0 mil to 4.0 mil) to the spark plug thread, agitating during use of sprayed from a pressure pot; (f) baking the spark plug for 30 minutes at a metal temperature of 725° F. In this embodiment, a PTFE mixture similar to DuPont 851 G-214 having weight solids % of 42.2, volume solids 23.9, density, kg/L 11.1 (1.3 lb/gal), viscosity 300-600, with a maximum in-use temperature of 260° C. (500° F.) has been found to be effective. Similarly effective has a PTFE mixture similar to DuPont 851 G-221 having weight solids % of 45.1, volume solids % 27.5-29.3, density, kg/L 11.3 (1.35 lb/gal), viscosity 300-600, with a maximum in-use temperature of 260° C. (500° F.). Similarly effective has been a PTFE mixture similar to DuPont 851 G-224 having weight solids % of 45.1, volume solids % 27.3-29.1, density, kg/L 11.1 (1.3 lb/gal), viscosity 300-600, with a maximum in-use temperature of 260° C. (500° F.). Similarly effective has been a PTFE mixture similar to DuPont 851 G-255 having weight solids % of 40.9, volume solids % 26.5-28.4, density kg/L 10.5 (1.25 lb/gal), viscosity 300-600, with a maximum in-use temperature of 260° C. (500° F.).

In a fifth embodiment, the spark plug threads are coated with a polytetrafluoroethylene mixture comprising the steps of (a) bringing the spark plug to room temperature of 21° C. to 26° C. (70° F. to 79° F.); (b) cleaning the surface of the spark plug by using a vapour degrease or by prebaking and lightly grit-blasting with aluminum oxide; (c) applying a minimum dry film thickness of 15 microns to 20 microns (0.6 mil to 0.8 mil) to the spark plug thread; (f) baking the spark plug for 15 minutes at a metal temperature of 343° C. (650° F.). In this embodiment, a PTFE mixture such as DuPont 958G-303 having weight solids % of 23.0-26.0, volume solids % 15.5-17.5, density, kg/L 1.06 (8.8 lb/gal), viscosity 200-870, with a maximum in-use temperature of 260° C. (500° F.) has been found to be effective. Similarly effective has been DuPont 958G313 having weight solids % of 23.5-26.5, volume solids % 15.8-17.8, density, kg/L 1.07 (8.9 lb/gal), viscosity 200-870, with a maximum in-use temperature of 260° C. (500° F.).

The scope of the claims should not be limited by the preferred embodiments set forth in the examples, but should be given the broadest interpretation consistent with the description as a whole. It is therefore to be understood that numerous modifications may be made to the illustrative embodiments and that other arrangements may be devised without departing from the spirit and scope of the present invention.

One or more of the embodiments of the invention in which an exclusive property or privilege is claimed are defined as follows:

1. A method for coating spark plug threads with a polytetrafluoroethylene mixture comprising the steps of:

(a) bringing the spark plug to room temperature of 21° C. to 26° C. (70° F. to 79° F.);

(b) mixing the polytetrafluoroethylene mixture thoroughly and filtering the material through a 100-mesh stainless steel screen (0.146 mm openings);

(c) applying a minimum dry film thickness of 20 microns to 30 microns (0.8 mil to 1.2 mil) to the spark plug thread; and (d) baking the spark plug for 15minutes at a metal temperature of 232° C. to 260° C. (450° F. to 500° F.).

2. A method for coating spark plug threads with a polytetrafluoroethylene mixture comprising the steps of:

(a) bringing the spark plug to room temperature of 21° C. to 26° C. (70° F. to 79° F.);

(b) cleaning the surface of the spark plug by using a vapour degrease or by prebaking;

(c) lightly grit-blasting the surface of the spark plug with aluminum oxide (e.g. 120-180 microinches);

(d) mixing the polytetrafluoroethylene mixture thoroughly and filtering the material through a 100-mesh stainless steel screen (0.146 mm openings);

(e) applying a minimum dry film thickness of 20microns to 30 microns (0.8 mil to 1.2 mil) to the spark plug thread; and (f) baking the spark plug for 15 minutes at a metal temperature of 232° C. to 260° C. (450° F. to 500° F.).

3. A method for coating spark plug threads with a polytetrafluoroethylene mixture comprising the steps of:

(a) bringing the spark plug to room temperature of 21° C. to 26° C. (70° F. to 79° F.);

(b) cleaning the surface of the spark plug by using a vapour degrease or by prebaking;

(c) applying one or more conversion coatings for corrosion protection;

(d) mixing the polytetrafluoroethylene mixture thoroughly and filtering the material through a 100-mesh stainless steel screen (0.146 mm openings);

(e) applying a minimum dry film thickness of 20 microns to 30 microns (0.8 mil to 1.2 mil) to the spark plug thread; and (f) baking the spark plug for 15 minutes at a metal temperature of 232° C. to 260° C. (450° F. to 500° F.).

4. A method for coating spark plug threads with a polytetrafluoroethylene mixture comprising the steps of:

(a) bringing the spark plug to room temperature of 21° C. to 26° C. (70° F. to 79° F.) and mixing or rolling thoroughly at 30 rpm for 30 minutes to 60 minutes;

(b) stringing the polytetrafluoroethylene mixture thorough a 100-mesh stainless steel screen (0.146 mm openings);

(c) using conventional industrial air-assisted spray equipment to apply a minimum film thickness of 20 microns (0.8 mil) to the spark plug thread; and (d) baking the spark plug for 15 minutes at a metal temperature of 370° C. for 10 minutes or 400° C. for 5 minutes.

5. A method for coating spark plug threads with a polytetrafluoroethylene mixture comprising the steps of:

(a) bringing the spark plug to room temperature of 21° C. to 26° C. (70° F. to 79° F.);

(b) cleaning and degreasing the surface of the spark plug by gritblasting to achieve a Ra of 2.51 microns (110-125 M in) maximum;

(c) mixing the polytetrafluoroethylene mixture thoroughly and filtering the material through a 60-mesh stainless steel screen (250 mm openings);

(d) applying a minimum dry film thickness of 25 microns to 100 microns (1.0 mil to 4.0 mil) to the spark plug thread; and (e) baking the spark plug for 20-30 minutes at a metal temperature of 370° F. to 370° F.).

6. A method for coating spark plug threads with a polytetrafluoroethylene mixture comprising the steps of:

(a) bringing the spark plug to room temperature of 21° C. to 26° C. (70° F. to 79° F.);

(b) mixing the polytetrafluoroethylene mixture thoroughly and filtering the material through a 100-mesh stainless steel screen (250 mm openings);

(c) using conventional industrial spray equipment applying a minimum dry film thickness of 25 microns to 100 microns (1.0 mil to 4.0 mil) to the spark plug thread, agitating during use of sprayed from a pressure pot; and (d) baking the spark plug for 30 minutes at a metal temperature of 725° F.

* * * * *